United States Patent [19]

Vandebult

[11] 4,429,302

[45] Jan. 31, 1984

[54] ELECTRONIC SECURITY SYSTEM WITH NOISE REJECTION

[75] Inventor: Jan Vandebult, Topsfield, Mass.

[73] Assignee: I. D. Engineering, Inc., Ipswich, Mass.

[21] Appl. No.: 309,715

[22] Filed: Oct. 8, 1981

[51] Int. Cl.[3] ..... G08B 13/24

[52] U.S. Cl. ..... 340/572; 343/6.5 LC; 343/6.8 LC

[58] Field of Search ..... 340/572; 343/6.8 LC, 343/6.8 R, 6.5 LC, 6.5 R

[56] References Cited

U.S. PATENT DOCUMENTS 3,828,337 8/1974 Lichtblau ..... 340/572

4,117,466 9/1978 Lichtblau ..... 340/572

*Primary Examiner*—Glen R. Swann, III

*Attorney, Agent, or Firm*—Schwartz, Jeffery, Schwaab, Mack, Blumenthal & Koch

[57] ABSTRACT

The system includes a transmitter producing an electromagnetic field at a frequency repetitively swept through a predetermined range at a predetermined sweep frequency. A receiver senses a resonant frequency produced by a resonant tag circuit when the tag circuit is within the electromagnetic field and produces an output signal in response to the resonant frequency. A first noise rejection circuit is provided which accepts the output of the receiver and produces a pulse in response to selected output signals from the receiver. The selected output signals include an initial output signal and successive output signals which occur at an interval from the previous selected output signal which is at least as great as the period of the sweep frequency. The circuit then compares the frequency of the pulses produced with the sweep frequency and produces an alarm signal when the pulse frequency and sweep frequency are substantially equal. Additional circuitry is provided which produces an inhibit pulse coincident with a known disturbance signal. A gate inhibits the production of the alarm signal in response to the inhibit pulse.

10 Claims, 9 Drawing Figures

ELECTRONIC SECURITY SYSTEM WITH NOISE REJECTION

BACKGROUND OF THE INVENTION

1. Field of the Invention

This invention relates to electronic security systems and especially to such systems which are designed to reduce or eliminate inadvertent alarm actuations in response to interference signals.

2. Discussion of Related Art

Electronic security systems are known which detect the presence of a resonant tag circuit which may be attached to an article. Such systems are especially useful to prevent theft in retail stores, and the unauthorized removal of books or documents from a secure location, or the like. However, such systems are known to be susceptible to producing a false alarm when interfering noise signals are present in the vicinity. An inadvertent alarm can cause embarrassment in a retail store environment by prompting security personnel to detain a shopper who may coincidentally be passing the security system at the time of the alarm. Further, an inadvertent alarm gives notice to persons in the vicinity of the existence of a security system which may lead to a knowledgeable thief taking steps to avoid detection. Consequently, a need has arisen for noise rejection circuitry which is readily adapted for use in an electronic security system.

Noise rejection circuitry has been suggested in the past. For example, U.S. Pat. No. 3,828,337 to Lichtblau discloses such circuitry in which true signals are distinguished from noise by sensing the absence of one or more pulses in an expected train of pulses produced by the resonant tag. The Lichtblau patent is deficient in that timing circuits are required which must be within certain tolerances. If these tolerances vary, the circuitry operation degrades drastically.

SUMMARY OF THE INVENTION

An object of the present invention is to provide an electronic security system with noise rejection circuitry which can effectively eliminate unwanted alarm actuations due to either sporatic or periodic interference signals received by the system.

A further object of the present invention is to provide an electronic security system having noise rejection circuitry which has a high accuracy produced by directly comparing the sweep frequency of the system to the frequency of pulses produced in response to the system resonant tag circuit.

Yet another object of the present invention is to provide an electronic security system in which the noise rejection circuitry is relatively uncomplicated, yet is highly effective in use.

Another object of the present invention is to provide an electronic security system having noise rejection circuitry which will not be adversely affected by slight operating variations in the components of the noise rejection circuitry.

In accordance with the above and other objects, the present invention comprises a transmitter for producing an electromagnetic field at a frequency repetitively swept through a predetermined range at a predetermined sweep frequency. A resonant tag circuit is provided having a resonant frequency within the sweep range. A receiver produces an output signal in the form of a pulse in response to a resonant frequency produced by the tag circuit each time the field produced by the transmitter passes through the resonant frequency of the tag circuit. The noise rejection circuitry of the invention receives the output signals from the receiver and produces a pulse in response to selected ones of the output signals. The selected output signals comprise an initial output signal and successive output signals which occur at an interval from the previous selected output signal which is at least as great as the period of the sweep frequency. Rejection circuitry then compares the frequency of the pulses produced in response to the receiver output signals with the sweep frequency. An alarm signal is produced whenever the pulse signal and the sweep frequency signal are substantially equal.

In accordance with other aspects of the invention, the noise rejection circuitry comprises a first non-retriggerable monostable multivibrator (MMV) which produces a pulse having a width which is less than the period of the sweep frequency. A second non-retriggerable MMV is actuated by the trailing edge of the pulse from the first MMV and has a width which is equal to approximately one-half of the period of the sweep frequency. Accordingly, in response to the presence of a tag circuit, the second MMV produces a periodic pulse having a frequency equal to the frequency of the sweep signal.

A second noise rejection circuit is also provided which eliminates unwanted alarm signals resulting from a known periodic disturbance signal which has a frequency within the swept band. The second noise rejection circuit produces inhibit pulses which are coincident with the duration of the disturbance signals. A gate is responsive to the inhibit pulses for inhibiting the production of an alarm signal during the occurrence of the disturbance signals.

BRIEF DESCRIPTION OF THE DRAWINGS

The above and other objects of the present invention will become more readily apparent when the invention is more fully described in the detailed description hereinbelow, reference being had to the accompanying drawings in which like reference numerals represent like parts throughout and in which.

DETAILED DESCRIPTION OF THE PREFERRED EMBODIMENTS

Figure 1:
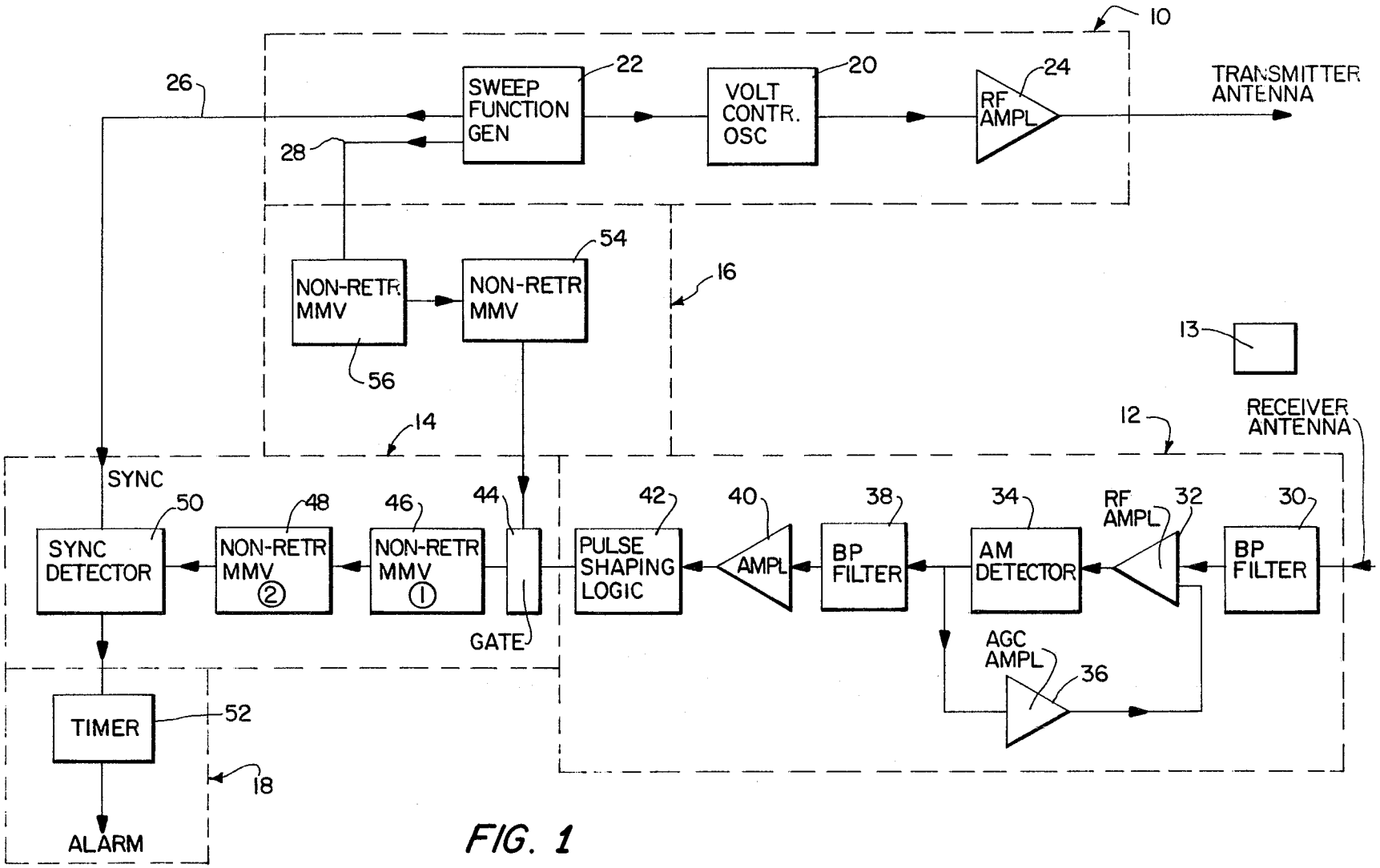
FIG. 1 is a block diagram depicting an electronic security system incorporating a first embodiment of noise rejection circuitry according to the present invention.

FIG. 1 shows an electronic security system according to the present invention. The system includes a transmitter 10 which produces an output signal repetitively swept over a predetermined frequency range at a predetermined sweep frequency. The signal from transmitter 10 is received by receiver 12 which processes the signal and extracts resonant frequency signals produced by tag circuit 13 from the received signal and produces output pulses in response to the resonant frequency signals. The output pulses from the receiver pass through random noise rejection circuit 14 and cause an alarm to actuate through timer 52. Periodic noise pulses are detected by circuit 16 and cause gate 44 to inhibit the passage of pulses from receiver 12 which are produced in response to the periodic noise signals.

Transmitter 10 is a generally known transmitter and comprises a voltage controlled oscillator 20 which is swept through a predetermined output voltage range by sweep function generator 22. The output of generator 22 can be any periodic wave form. In the present case, the sweep signal produced by generator 22 can be seen to be a triangular wave form of period T depicted in FIG. 3A. The signal produced by voltage controlled oscillator 20 is amplified in amplifier 24 and transmitted through a transmitter antenna which produces an electromagnetic field. Tag 13 contains a resonant circuit having a resonant frequency within the range of the swept frequencies of the field created by the transmitter antenna. When the tag 13 is within range of the field, the resonant circuit of the tag distorts the field by producing an output in the form of an amplitude modulated pulse at the resonant frequency of the tag when the frequency of the field passes through the tag resonant frequency.

Figure 3:
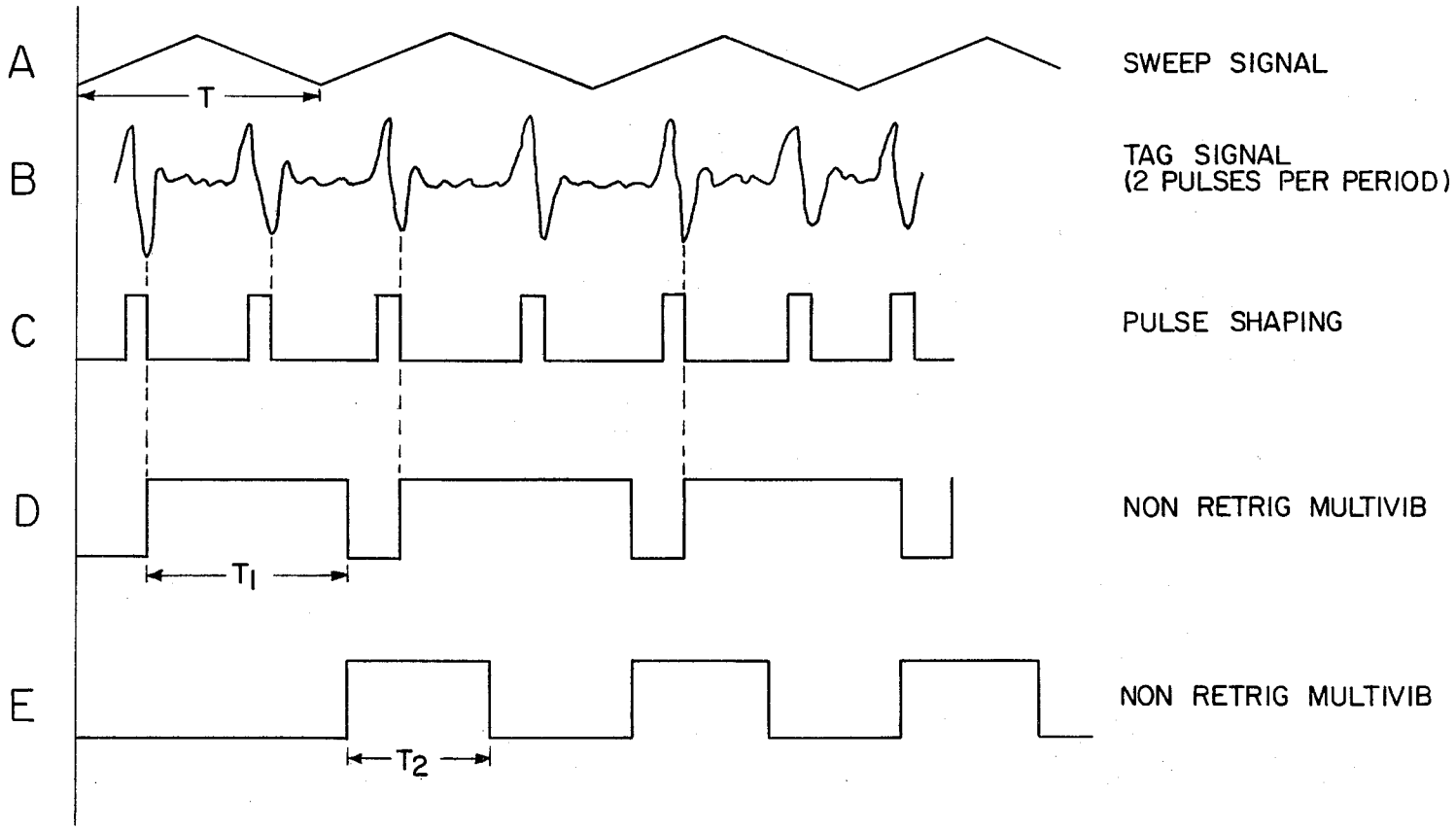
FIG. 3 is a timing diagram useful for explaining the operation of the noise rejection circuitry used for eliminating random noise signals.

Receiver 12 is connected to a receiver antenna. The signal from the antenna is passed through a bandpass filter 30 which has a pass band equivalent to the frequency output range of the transmitter. The filtered received signal is amplified in amplifier 32 and passed to amplitude modulation detector 34 wherein the amplitude modulated pulses are extracted from the received signal. An automatic gain control amplifier 36 acts with amplifier 32 to maintain the amplitude of the pulses within a predetermined range. As shown in FIG. 3B, two tag signal pulses are produced per period of the sweep signal. The tag signal pulses are passed by a band pass filter 38 and amplified by amplifier 40. Pulse shaping logic 42 outputs square wave pulses shown in FIG. 3C in response to each of the tag signal pulses.

At this point, the shaped pulse signals may be used to operate an alarm to indicate the presence of a resonant tag 13. However, by so operating an alarm, the system would be very susceptible to spurious noise signals which would inadvertently set off the alarm. According to the present invention, the pulses emitted from logic circuit 42 are passed through normally open gate 44 to a first non-retriggerable multivibrator (MMV) 46. MMV 46 produces a pulse having a width T1 which is slightly less than the period T of the sweep signal from generator 22. Accordingly, it will be seen that one pulse is output from MMV 46 at a maximum of once per period of the sweep signal. That is, only one pulse is emitted from MMV 46 for every second pulse received from the logic circuit 42. Extra pulses or signals received in the form of noise or interference during the activation time T1 of MMV 46 do not affect the setting of the MMV. Consequently, the output of MMV 46 constitutes a train of pulses with a repetition rate equal to the sweep frequency when a tag is present in the electromagnetic field.

The output of MMV 46 is fed to a second non-retriggerable MMV 48 which produces a pulse having a width which is approximately equal to one-half the period of the sweep signal. MMV 48 is triggered on the trailing edge of MMV 46. The output of MMV 48 is seen in FIG. 3E to be a periodic pulse having a frequency equal to the frequency of the sweep signal when a tag circuit is present. This output signal is fed to synchronous detector 50 which also received an output on line 26 from sweep function generator 22. This output is also the sweep control signal shown in FIG. 3A and acts as a sync. signal. Synchronous detector 50 compares the frequency of the synch. signal on line 26 to the output signal from MMV 48. If these frequencies are approximately equal, synchronous detector 50 sends an output signal to timer 52 which actuates an alarm for a predetermined time duration. Clearly, if desired, a time delay circuit could be inserted between detector 50 and timer 52 so that the alarm would sound only after a predetermined number of cycles of the sync. signal are compared to the output from MMV. 48.

Clearly, if pulses are now produced by logic circuit 42 at a repetitious rate not equal to the frequency of the sweep signal produced by generator 22, synchronous detector 50 will not produce an output signal for actuating the alarm. Furthermore, any noise signals which are passed through logic circuit 42 which are not at the sweep frequency will not produce the proper signal from MMV 48 to actuate the alarm. Finally, any noise signals which are passed through logic circuit 42 between actuations of MMV 46 by a true tag signal will simply be rejected and will have no effect on the output from MMV 48.

Figure 4:
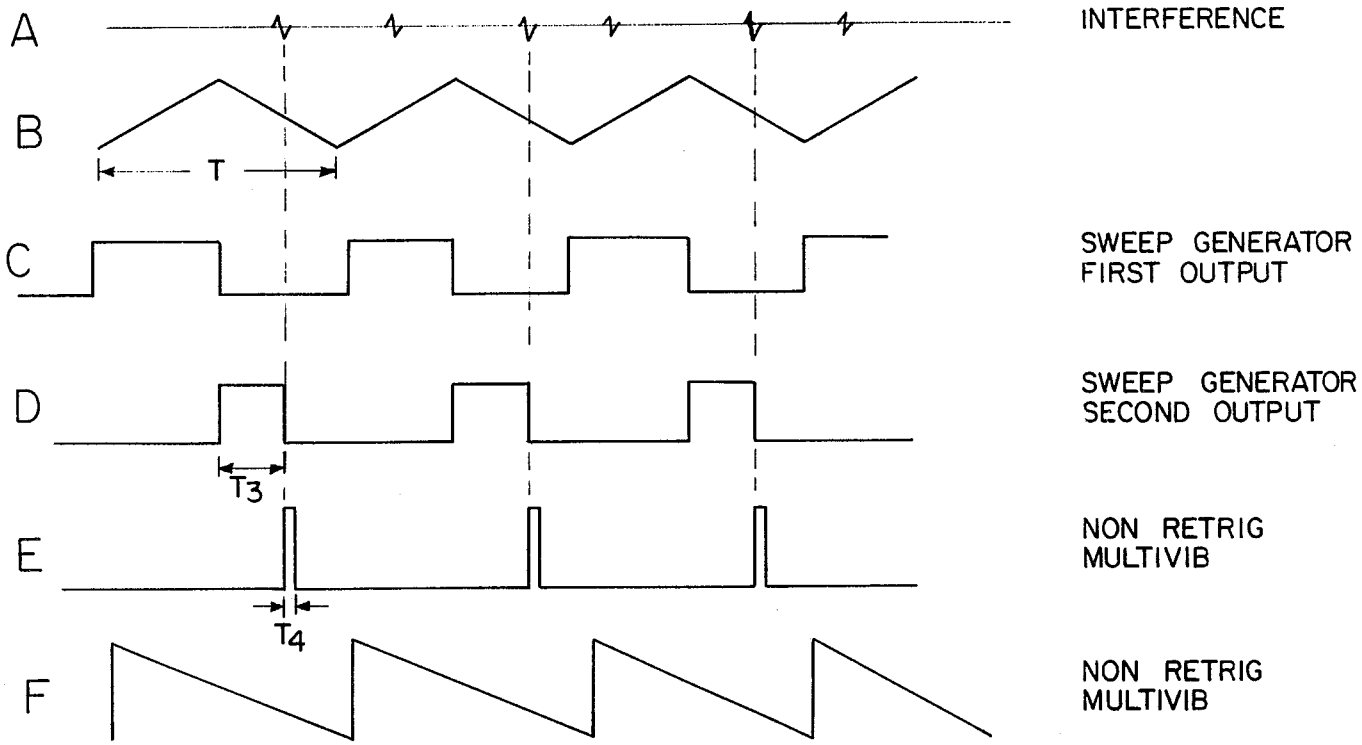
FIGS. 4A–4F are timing diagrams useful for explaining the operation of the noise rejection circuitry used for eliminating periodic interference signals.

Occasionally, noise signals are generated in the vicinity of receiver 12 which are within the frequency range of the receiver. Such signals may be produced by nearby transmitters or the like. When the frequency of the output of transmitter 10 passes near the frequency of the noise source, a pulse may be generated which appears to be a tag circuit pulse. Alternatively, structures within the vicinity of the electronic security system, such as metal door frames, or the like, may prove to be natural resonant circuits which also produce perturbations which appear similar to tag signals. Consequently, since such noise signals are in part produced by the signal generated by the security system, they will cause interference signals which may appear the same as tag signals, and thus prove to be a difficult problem to overcome. However, such periodic noise signals can be rejected by noise rejection circuit 16 of the present invention. The operation of circuit 16 can be best clearly understood with reference to the timing diagrams A-F of FIG. 4. FIG. 4A shows the disturbance signals which occur twice per period of the sweep generator output signal shown in FIG. 4B. The noise rejection circuit 16 comprises a first non-retriggerable MMV 56 which receive a second output from function generator 22 on line 28. The output on line 28 is shown in FIG. 4C to comprise a square wave having a frequency equal to the triangular wave of FIG. 4B. The trailing edge of the output on line 28 activates MMV 56 which produces a pulse having a width of T3 shown in FIG. 4D. The pulse width T3 is manually adjustable to accommodate the positioning of the interference signals. The trailing edge of the pulse from MMV 56 activates a non-retriggerable MMV 54 which produces a pulse having a width T4 shown in FIG. 4E. The pulse width T4 is predetermined and chosen to be equal to the expected duration of an interference signal. The output of MMV 54 is fed to a gate 44 which is connected to the output of logic circuit 42. Accordingly, gate 44 is inhibited by the pulses emitted from MMV 54 thereby not allowing any pulses produced in response to period interference signals from reaching MMV 46.

It should be noted that circuit 16 must be adjusted manually after the electronic security system is in place. When the security system is operative, if any period noise pulses are detected, as by an unwanted actuation of the system alarm, the pulse width of MMV 56 is simply increased until the unwanted alarm actuation ceases. It should also be noted that circuit 16 described herein is effective for eliminating only those interference signals which are produced in response to the downward sweep of the sweep generator 22 output. Clearly, if all interference signals are to be eliminated, MMVs 56 and 64 must be duplicated and made responsive to the leading edge of the generator output on line 28. Of course, sweep function generator 22 could be chosen to produce a sawtooth wave function shown in FIG. 4F which would produce only a single interference signal per cycle, in which case MMVs 56 and 54 would be effective for eliminating all synchronous noise signals.

Figure 2:
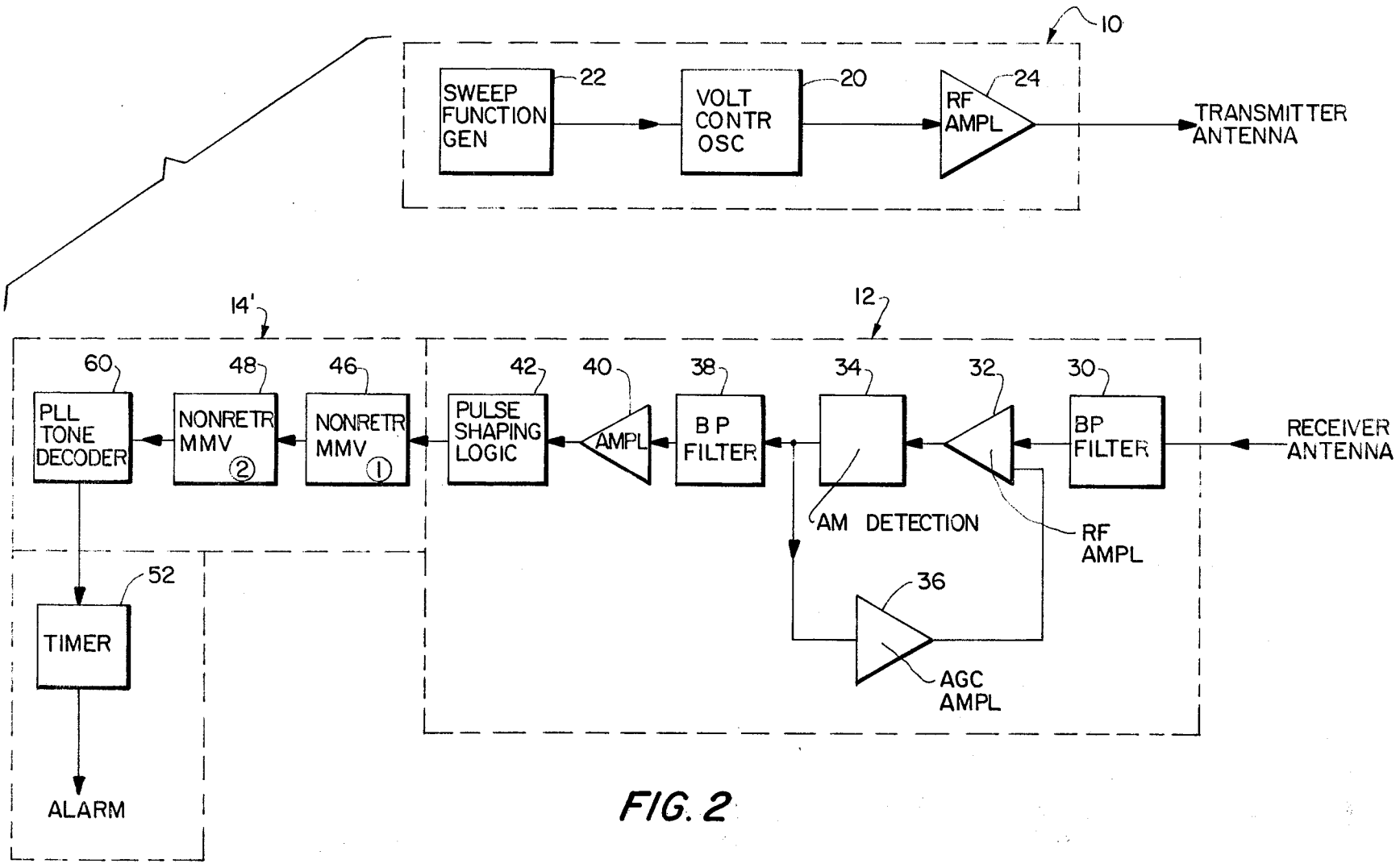
FIG. 2 is a block diagram depicting an electronic security system incorporating a second embodiment of noise rejection circuitry according to the present invention.

FIG. 2 shows an electronic security system which utilizes an alternative spurious noise rejection circuit 14'. No synchronous noise detection circuit equivalent to circuit 16 is used in the embodiment of FIG. 2. The advantage of the embodiment of FIG. 2 is that the transmitter circuit 10 can be completely separate from the receiving section of the system. The separation of the sections of the system is accomplished by the use of a phase-locked loop tone decoder 60 in place of synchronous detector 50. Tone decoder 60 may be a standardly available integrated circuit such as a Signetics NE567 tone decoder. Decoder 60 has an internal frequency generator which can be set at the frequency of function generator 22. The internally generated signal is compared to the output of MMV 48. An output is produced when the frequencies are approximately equal. Decoder 60 also allows the user to adjust the number of cycles to be compared prior to introduction of an output and allows an acceptable deviation in frequency between the internally generated frequency and the frequency of the signal received from MMV 48.

Clearly, if desired, the system of FIG. 2 could be built to incorporate a synchronous noise detection circuit 16 as shown in FIG. 1. In order to do so, a gate 44 and MMVs 56 and 54 must be added to the circuit of FIG. 2.

It should be noted that the width T1 of MMV 46 is made only slightly less than period T of sweep function generator 22 in order to eliminate the effects of sporadic noise signals occurring between tag pulses. However, at times the noise signal level may be so high and the frequency of noise signals so great that MMV 46 is continuously triggered by the noise. This may produce a situation where the alarm is sounded. To overcome this difficulty, it is possible to reduce pulse width T1 or eliminate MMV 46 entirely. In this case, the frequency of pulses from MMV 48 due to the noise signals would be greater than the sweep frequency thus, detector 50 or decoder 60 would not lock onto the output of MMV 48 and the alarm would not sound. The frequency of pulses from MMV 48 produced in response to the tag signals would remain the same since the pulse width T2 of MMV 48 is one half of the period T and thus will respond to only alternate tag signals.

While several embodiments of the invention have been described hereinabove, these are considered descriptive but not limitative of the present invention. Clearly, numerous modifications, changes and other alternations of the invention can be made without departing from the scope and spirit thereof as set forth in the appended claims.

What is claimed is:

1. An electronic security system comprising:

transmitter means for producing an electromagnetic field at a frequency repetitively swept through a predetermined range at a predetermined sweep frequency;

a resonant tag circuit having a resonant frequency within the sweep range;

receiver means for producing an output signal in response to a tag signal produced by said tag circuit each time the field produced by said transmitter means passes through said resonant frequency;

circuit means for producing a pulse in response to selected output signals of said receiver means, said selected output signals being an initial output signal and each successive output signal which occurs at an interval from the previous selected output signal which is at least as great as the period of said sweep frequency; and means for comparing the frequency of pulses produced by said circuit means with said sweep frequency and producing an alarm signal when said pulse frequency and said sweep frequency are substantially equal.

2. The system as set forth in claim 1 wherein said circuit means includes a first non-retriggerable monostable multivibrator producing a pulse having a width slightly less than the period of said sweep frequency and a second non-retriggerable monostable multivibrator connected for receiving the output of said first non-retriggerable monostable multivibrator and producing a pulse having a width approximately equal to one-half the period of said sweep frequency.

3. The system as set forth in claim 2 wherein said comparing means comprises a synchronous detector having one input connected to receive pulses from said second non-retriggerable monostable multivibrator and having a second input connected to receive an output signal from said transmitter at said sweep frequency.

4. The system as set forth in claim 2 wherein said comparing means comprises a tone decoder circuit having an internal frequency generator set at said sweep frequency.

5. The system as set forth in claim 1 and further including means for producing an inhibit pulse coincident with a known disturbance signal; and gate means responsive to said inhibit pulse for inhibiting the production of said alarm signal during the occurrence of said disturbance signal.

6. The system as set forth in claim 5 wherein said inhibit pulse producing means includes a non-retriggerable monostable multivibrator connected to receive an output from said transmitter means at said sweep frequency and producing a pulse having a manually variable pulse width in response to said signal from said transmitter means.

7. The system as set forth in claim 6 wherein said inhibit pulse producing means further includes a second non-retriggerable monostable multivibrator connected to receive pulses from said first-recited non-retriggerable monostable multivibrator and produce output pulses in response thereto having a pulse width equal to the anticipated duration of said known disturbance signal.

8. An electronic security system, comprising:

transmitter means for producing an electromagnetic field at a frequency repetitively swept through a predetermined range at a sweep frequency;

a resonant tag circuit having a resonant frequency within said sweep range;

receiver means for producing an output pulse in response to a tag signal produced by said tag circuit each time the field produced by said transmitter means passes through said resonant frequency;

means for producing an inhibit pulse coincident with a known disturbance signal having a repetition rate equal to said sweep frequency, said inhibit pulse producing means including a non-retriggerable monostable multivibrator connected to receive an output from said transmitter means at said sweep frequency and producing a pulse having a manually variable pulse width in response thereto; and gate means responsive to said inhibit pulse for inhibiting output signals from said receiver means during said disturbance signal; and means for actuating an alarm when the frequency of pulses from said receiver means equals said sweep frequency.

9. The system as set forth in claim 8 wherein said inhibit pulse producing means further includes a second non-retriggerable monostable multivibrator connected to receive pulses from said first-recited non-retriggerable monostable multivibrator and produce output pulses in response thereto having a pulse width equal to the anticipated duration of said known disturbance signal.

10. An electronic security system comprising:

transmitter means for producing an electromagnetic field at a frequency repetitively swept through a predetermined range at a predetermined sweep frequency;

a resonant tag circuit having a resonant frequency within the sweep range;

receiver means for producing an output signal in response to a tag signal produced by said tag circuit each time the field produced by said transmitter means passes through said resonant frequency;

circuit means for producing a pulse in response to selected output signals of said receiver means, said selected output signals being an initial output signal and each successive output signal which occurs at an interval from the previous selected output signal which is at least as great as one-half the period of said sweep frequency; and means for comparing the frequency of pulses produced by said circuit means with said sweep frequency and producing an alarm signal when said pulse frequency and said sweep frequency are substantially equal.

* * * * *